US008647562B2

(12) United States Patent
Dourfaye et al.

(10) Patent No.: US 8,647,562 B2
(45) Date of Patent: Feb. 11, 2014

(54) PROCESS FOR THE PRODUCTION OF AN ELEMENT COMPRISING AT LEAST ONE BLOCK OF DENSE MATERIAL CONSTITUTED BY HARD PARTICLES DISPERSED IN A BINDER PHASE: APPLICATION TO CUTTING OR DRILLING TOOLS

(75) Inventors: Alfazazi Dourfaye, Paris (FR); Christophe Colin, Evry (FR); Elodie Sorlier, Paris (FR); Hedi Sellami, Montrouge (FR)

(73) Assignee: Varel International Ind., L.P., Carrollton, TX (US)

( * ) Notice: Subject to any disclaimer, the term of this patent is extended or adjusted under 35 U.S.C. 154(b) by 1109 days.

(21) Appl. No.: 12/056,595

(22) Filed: Mar. 27, 2008

(65) Prior Publication Data

US 2008/0240879 A1 Oct. 2, 2008

(30) Foreign Application Priority Data

Mar. 27, 2007 (FR) ..... 07 54061

(51) Int. Cl.
*C22C 1/05* (2006.01)

(52) U.S. Cl.
USPC ..... 419/18; 419/14

(58) Field of Classification Search
USPC ..... 164/332; 428/551; 75/236; 419/18, 14
See application file for complete search history.

(56) References Cited

U.S. PATENT DOCUMENTS

| | | | |
|---|---|---|---|
| 3,745,623 | A | 7/1973 | Wentorf, Jr. et al. |
| 4,225,322 | A | 9/1980 | Knemeyer |
| 4,402,764 | A | 9/1983 | Clark et al. |
| 4,548,786 | A | 10/1985 | Yohe |

(Continued)

FOREIGN PATENT DOCUMENTS

| | | | |
|---|---|---|---|
| DD | 203750 | A1 | 11/1983 |
| DE | 3112460 | A1 | 9/1982 |

(Continued)

OTHER PUBLICATIONS

Roebuck et al. ("Infiltration as A Method for Producing WC Hardmetals with Co and Ni Alloy binder-Phases", International Journal of Refractory and Hard Metals, vol. 3, No. 1, Mar. 1, 1984, pp. 35-40).*

(Continued)

*Primary Examiner* — Weiping Zhu
(74) *Attorney, Agent, or Firm* — Gardere Wynne Sewell LLP; Andre M. Szuwalski

(57) ABSTRACT

A process is presented which produces at least one block of dense material constituted by hard particles dispersed in a binder phase, it being possible for the dense material to be enriched locally with binder phase by imbibition. The process includes bringing at least one imbibition area of a surface of the block, preferably coated with a coating material, into contact with an imbibiting material which locally enriches the block with binder phase. The block in contact with the imbibiting material is then subjected to a suitable thermal cycle constituted by heating, temperature maintenance and cooling. This serves to bring some or all of the imbibiting material and the binder phase of the block into the liquid state in such a manner that the enrichment with binder phase takes place solely through the imbibition area. The block is used in connection with the building of a drill bit or tool.

45 Claims, 4 Drawing Sheets

(56) References Cited

U.S. PATENT DOCUMENTS

| | | | | |
|---|---|---|---|---|
| 4,604,106 | A | 8/1986 | Hall | |
| 4,610,931 | A | 9/1986 | Nemeth et al. | |
| 4,664,705 | A | 5/1987 | Horton et al. | |
| 4,726,718 | A | 2/1988 | Meskin et al. | |
| 4,729,440 | A | 3/1988 | Hall | |
| 4,743,515 | A | 5/1988 | Fischer et al. | |
| 4,820,482 | A | 4/1989 | Fischer et al. | |
| 4,943,488 | A | 7/1990 | Sung et al. | |
| 5,011,514 | A | 4/1991 | Cho et al. | |
| 5,028,177 | A | 7/1991 | Meskin et al. | |
| 5,079,102 | A | 1/1992 | Tanaka et al. | |
| 5,111,895 | A | 5/1992 | Griffin | |
| 5,127,923 | A | 7/1992 | Bunting et al. | |
| 5,441,817 | A * | 8/1995 | Rai | 428/551 |
| 5,618,625 | A | 4/1997 | Okamura et al. | |
| 5,645,617 | A | 7/1997 | Frushour | |
| 5,713,133 | A | 2/1998 | Bhat et al. | |
| 5,880,382 | A | 3/1999 | Fang et al. | |
| 5,889,219 | A * | 3/1999 | Moriguchi et al. | 75/236 |
| 6,054,693 | A | 4/2000 | Barmatz et al. | |
| 6,443,248 | B2 | 9/2002 | Yong et al. | |
| 6,562,462 | B2 | 5/2003 | Griffin et al. | |
| 6,620,375 | B1 | 9/2003 | Tank et al. | |
| 6,869,460 | B1 | 3/2005 | Bennett et al. | |
| 7,377,341 | B2 | 5/2008 | Middlemiss et al. | |
| 7,396,501 | B2 | 7/2008 | Pope et al. | |
| 7,487,849 | B2 | 2/2009 | Radtke | |
| 7,533,740 | B2 | 5/2009 | Zhang et al. | |
| 7,569,179 | B2 | 8/2009 | Fang | |
| 7,887,747 | B2 | 2/2011 | Iwasaki et al. | |
| 2002/0051848 | A1 | 5/2002 | Li | |
| 2002/0077054 | A1 | 6/2002 | Sung | |
| 2002/0096306 | A1 * | 7/2002 | Butcher et al. | 164/332 |
| 2004/0094333 | A1 | 5/2004 | Yamamoto et al. | |
| 2005/0050801 | A1 | 3/2005 | Cho et al. | |
| 2005/0230155 | A1 | 10/2005 | Sung | |
| 2005/0276717 | A1 | 12/2005 | Fang | |
| 2006/0060392 | A1 | 3/2006 | Eyre | |
| 2006/0254830 | A1 | 11/2006 | Radtke | |
| 2007/0131459 | A1 | 6/2007 | Voronin et al. | |
| 2007/0214913 | A1 | 9/2007 | Fang | |
| 2008/0142276 | A1 | 6/2008 | Griffo et al. | |
| 2008/0185189 | A1 | 8/2008 | Griffo et al. | |
| 2008/0223623 | A1 | 9/2008 | Keshavan et al. | |
| 2008/0230280 | A1 | 9/2008 | Keshavan et al. | |
| 2008/0240879 | A1 | 10/2008 | Dourfaye et al. | |
| 2009/0173547 | A1 | 7/2009 | Voronin et al. | |
| 2009/0226688 | A1 | 9/2009 | Fang | |
| 2010/0151266 | A1 | 6/2010 | Arvanitidis | |
| 2011/0042147 | A1 | 2/2011 | Fang et al. | |
| 2011/0174550 | A1 | 7/2011 | Colin et al. | |

FOREIGN PATENT DOCUMENTS

| | | | |
|---|---|---|---|
| EP | 1975264 | A1 | 10/2008 |
| GB | 2438073 | | 11/2007 |
| JP | 62074076 | A | 4/1987 |
| WO | 9308952 | A1 | 5/1993 |
| WO | WO 2009/111749 | | 9/2009 |

OTHER PUBLICATIONS

Park et al. ("Anomalous growth of the Complex Carbide Phase in Carbon-Deficient WC-Co hard Metal During the Infiltration of Eutectic Liquid", Mater. Sci. Eng. A Struct. Mater. Prop. Microstruct. Process, Nov. 1988, vol. A105-6, No. part 1, Nov. 9, 1987, pp. 233-236).*

O. Eso, Z. Fang, A. Griffo, Liquid phase sintering of functionally graded WC-Co composites, International Journal of Refractory Metals & Hard Materials, 23, (2005) 233-241.

C. Colin and F. Delannay, Effect of shape accommodation on the equilibrium distribution of liquid in assemblies of WC/Co cermets, Proceedings 4th International Conference on Science, Technology and Applications of Sintering, 2005, 188-191.

Park Jong-Ku, et al., "Anomalous Growth of the Complex Carbide Phase in Carbon-deficient WC-Co Hard Metal during the Infiltration of Eutectic Liquid," Materials Science and Engineering, vol. A105-6, No. part 1, (1998), pp. 233-236, Nov. 9, 1987; XP-002458195.

Roebuck, et al., "Infiltration as a Method for Producing WC Hardmetals with Co and Ni Alloy Binder-Phases," International Journal of Refractory and Hard Metals, MPR Publishing Services Ltd., Shrewbury, GB, vol. 3, No. 1, Mar. 1, 1984, pp. 35-40, XP 000569229; ISSN: 0263-4368.

Jain, et al., "Processing of Functionally Graded WC/Co/Diamond Nanocomposites," Scripta Materialia, Elsevier, Amsterdam, NL, vol. 44, No. 8-9, May 18, 2001, pp. 2099-2103; XP004327717; ISSN: 1359-6462.

Preliminary French Search Report and Written Opinion, FR 07 54061, dated Nov. 12, 2007.

E. Sorlier et al., "Elaboration de gradients de composition continue dans des taillants PDC", Materiaux 2006, Nov. 13-17, 2006, Dijon, France, May 10, 2007, http://hal.archives-ouvertes.fr/docs/00/14/45/46/PDF/Sorlier-Colin_Materiaux_2006_Dijon_9_pdf, XP002532888 (9 pages).

PCT International Search Report and Written Opinion for PCT/US2009/060547, dated Dec. 14, 2009 (10 pages).

PCT International Search Report for PCT/FR2009/051910, dated Jan. 29, 2010 (4 pages).

E. Sorlier et al., "HAL: hal-00144546, version 1—Elaboration de gradients de composition continue dans des taillants PDC", http:://hal.archives-ouvertes.fr/hal-001445461en/, Abstract, May 10, 2007 (1 Page).

P. Cao, et al.: "Optimization Design and Residual Thermal Stress Analysis of PDC Functionally Graded Materials," J. Zhejiang Univ. Science A, 2006 7(8), pp. 1318-1323.

* cited by examiner

PROCESS FOR THE PRODUCTION OF AN ELEMENT COMPRISING AT LEAST ONE BLOCK OF DENSE MATERIAL CONSTITUTED BY HARD PARTICLES DISPERSED IN A BINDER PHASE: APPLICATION TO CUTTING OR DRILLING TOOLS

PRIORITY CLAIM

The present application is a translation of and claims priority from French Application for Patent No. 07 54061 of the same title filed Mar. 27, 2007, the disclosure of which is hereby incorporated by reference.

BACKGROUND OF THE INVENTION

1. Technical Field of the Invention

The present invention relates to the production of elements comprising at least one block of dense material constituted by hard particles dispersed in a ductile binder phase, it being possible for the dense material to be enriched locally with binder phase by imbibition. The invention relates more particularly to the production of tools made of ceramic/metal composite, which is also known as cermet, and more particularly of tools for use in oil and gas and/or mine drilling.

2. Description of Related Art

Drilling tools are constituted by bits surmounted by cutters for cutting or grinding materials such as rock. The cutters, which are the active part of the tool, are in most cases made of carbide, an extremely hard but brittle material. That fragility is particularly disadvantageous when such tools are used to drill geological layers constituted by rocks of different hardness, it being possible for such heterogeneities to cause impacts which may give rise to cracks in the cutters and thus lead to wear of the bits by flaking or to breaking of the cutters.

In order to reduce the risks of premature wear or of breaking of the cutters, it is known to create bits made of cermet (ceramic metal composite), the core of which is more ductile than the outside surface (which is in direct contact with the rock). The core of the bit will thus be more resistant to impacts (zone enriched with binder phase), while maintaining a good cutting ability (zone low in binder phase, which is in contact with the rock).

In order to produce such cutters, which are known as cutters having a composition gradient or property gradient called Functionally Graded Material (FGM), it has been proposed to produce non-dense cermets having a porosity gradient and to infiltrate with a binder phase in order to improve the ductility of a zone at the core of the cermet. However, that method is ill-suited, in particular to WC-Co systems, because it leads to the partial destruction of the carbide skeleton that exists prior to the imbibition and accordingly does not allow the desired properties of the cutter to be obtained.

It has also been proposed to produce cermets having a composition gradient, with a hard outside surface and a ductile core, by the natural sintering (without the application of external pressure) in solid phase of a multi-layer element, each of the layers having a different composition. However, that method does not allow the material to be densified completely and thus must be followed by an expensive hot isostatic compaction treatment. In addition, the preparation of the cermet having a composition gradient is complex because it requires the production of a series of elementary layers which fit one into the other, each layer having a different composition. Finally, that process, which is complex and very expensive, does not allow a continuous composition gradient to be obtained. Accordingly, a cermet so obtained comprises a succession of layers having substantially different hardnesses and coefficients of expansion, leading to the risk of delamination at the interface between two adjacent layers.

In order to remedy the disadvantages of solid-phase sintering, it has been proposed to produce such materials by natural liquid-phase sintering, which allows a material having a completely dense, gradual structure to be obtained very rapidly and in a single step. However, that process has the disadvantage of weakening the composition gradient quite considerably by virtue of the migration of liquid between the layers of small thickness. Furthermore, and wholly unexpectedly, the composition gradient remains discontinuous when the dwell time in the liquid state remains below a critical time beyond which complete homogenization of the cermet is noted.

For those various reasons, the three methods which have been proposed are not suitable for the industrial manufacture of drilling tools having satisfactory use properties, both wear resistance at the surface and ductility or toughness at the core.

In addition, in order to improve the working life of cutting tools, it has been proposed to deposit hard coatings of nitride, carbonitride, oxide or boride on the surface of cermets. Such methods have been described, for example, in U.S. Pat. No. 4,548,786 or 4,610,931, the disclosures of which are hereby incorporated by reference. However, those methods have the disadvantage that they only improve the resistance of the cermet to wear by abrasion, and that improvement is achieved only over small thicknesses (several microns). Moreover, because the nature of the coating differs from that of the bit, delamination or flaking of that layer may occur following thermomechanical stress of the cutter.

It has also been proposed to improve both the wear resistance of the surface and the impact resistance of cermets of the WC-Co type by bringing a cermet that is substoichiometric in terms of carbon into contact with a carbon-rich gaseous phase (methane). Under the effect of temperature, the carbon from the gaseous phase diffuses into the substoichiometric cermet and reacts with the η phase according to the chemical reaction $2C+Co_3W_3C$ (η phase)$\rightarrow 3WC+3Co$, resulting in the release of cobalt, which migrates towards the zones that are less rich in cobalt. However, that method, which is described, for example, in U.S. Pat. No. 4,743,515 (the disclosure of which is hereby incorporated by reference), has the disadvantage that it results in a binder phase gradient that is rich in cobalt over one or two millimeters, while the core of the cermet remains fragile because it is constituted by the η phase and can easily crack during repeated impacts.

Finally, it has been proposed to produce cutting tools having specific structures, especially honeycombed structures, which have the advantage of combining good wear resistance and good toughness. Such cermets having a functional microstructure exhibit a compromise of ductile/fragile properties which is of interest but remains inadequate for the intended application. That composite material is the subject of U.S. Pat. No. 5,880,382 (the disclosure of which is hereby incorporated by reference).

There is a need in the art to remedy the foregoing disadvantages.

Imbibition is understood as being an enrichment with a liquid of a completely dense solid/liquid system in which at least a solid phase is in the form of gains able to adapt their form by absorption of liquid, thus making the system more stable energetically. The enrichment with liquid is made under the effect of the driving power resulting from the migration pressure existing in such systems.

Infiltration is an enrichment with a liquid of a non completely dense solid/liquid system under only the driving power resulting from the capillarity also named capillary pressure. An impregnation involves a third phase named non condensed phase (gaseous phase) in addition to the two condensed phases (solid/liquid).

SUMMARY OF THE INVENTION

A means is proposed for permitting the production, under satisfactory industrial conditions, of blocks of dense cermet-based material which are intended for cutting or drilling tools. These blocks have both very good wear resistance at the surface and good core toughness, so as to have an improved lifetime as compared with that of conventional tools.

To that end, in an embodiment a process is presented for the production of an element (wherein the element comprises at least one block of dense material constituted by hard particles dispersed in a binder phase, it being possible for the dense material to be enriched locally and gradually in millimetric distances with binder phase by imbibitions with an imbibiting material. In accordance with the process, at least one imbibition area of a surface of the block is brought into contact with an imbibiting material capable of locally enriching the block with binder phase. The block, previously coated with a coating material, in contact with the imbibiting material is then subjected to a suitable thermal cycle constituted by heating, reaching a steady temperature (the dwell temperature) and cooling. This cycle brings some or all of the imbibiting material and the binder phase of the block into the liquid state, in such a manner that the enrichment with binder phase takes place solely through the imbibition area.

Preferably, the size of the imbibition area is smaller than that of the surface of the block with which the imbibiting material is to be brought into contact.

Before a surface of the block is brought into contact with the imbibiting material, all or part of the block, with the exception of the imbibition area, can be covered with a protective material, referred to as a coating material, in order on the one hand to prevent the imbibiting material from spreading after it has been brought into the liquid state and on the other hand to prevent diffusion of elements of the binder phase.

The coating material affects the kinetics of migration and is constituted, for example, by an anti-diffusion and/or anti-wetting material in respect of the imbibiting material, when the latter is liquid.

The thermal cycle is preferably carried out in such a manner that there forms in the assembly constituted by the block and the imbibiting material a temperature gradient such that the minimum imbibition temperature is reached at the interface between the block and the imbibiting material, and such that, in the block, the temperature is higher than the minimum imbibition temperature and, in the imbibiting material, at least in the vicinity of the interface, the temperature is below the minimum imbibition temperature.

The imbibiting material is constituted, for example, by a compact of powder agglomerated at low temperature under load, one face of which is in contact with a surface of the block.

The imbibiting material can also be in the form of a paste (mixture of a powder and an aqueous cement) deposited on a surface of the block, for example by means of a brush, or in the form of a plasma- or laser-projected coating. The advantage of such a form of the imbibiting material is that it can be adapted to all block geometries.

The block in contact with the imbibiting material is preferably disposed in a crucible made of a refractory material which is chemically inert to the imbibiting material, for example of aluminium oxide, and is heated in an oven under a controlled atmosphere or in vacuum.

The phases constituting the block generally comprise at least hard particles of one or more metal carbides, and a ductile metallic binder phase which preferably forms a eutectic at temperature with the metal carbide(s). The block can further be constituted by other hard particles, such as diamond particles.

The imbibiting material preferably has a composition similar to that of the binder phase of the block. For example, it is constituted of at least 85% by weight of a eutectic formed between the metal carbide(s) of the block and the metallic binder phase, the melting point of which is below or equal to or slightly higher than the melting point of the binder phase of the block, the metallic binder phase of the imbibiting material being constituted by one or more metal elements selected from Co, Fe, Ni, and of not more than 15% by weight of one or more metal elements selected from Cu, Si, Mn, Cr, Mo, W, V, Nb, Ta, Ti, Zr, Hf, the remainder being impurities.

The imbibition temperature is generally the melting point Te of the eutectic which constitutes the binder phase of the block at that same temperature.

The thermal cycle preferably comprises a rise in temperature to a holding temperature Tm which is higher than or equal to the eutectic temperature Te of the imbibiting material, and preferably below Te+200° C., preferably followed by a short dwell time at the temperature Tm, then by rapid cooling (approximately 50° C./min.) to a temperature below Te and finally by slower cooling (from 10 to 5° C./min.) to ambient temperature.

The material constituting the block can be a cermet of the WC-Co or WC-(Co and/or Ni and/or Fe) type, to which diamond particles may optionally have been added, and the imbibiting material is a eutectic of the WC-M type, M being constituted by one or more metals selected from Co, Ni and Fe.

The cermet constituting the block can especially be of the WC-Co type and can comprise not more than 35% by weight cobalt, and the imbibiting material can especially be a eutectic of the WC-Co type comprising not more than 65% by weight cobalt.

When a coating layer is deposited on the surface of the block, that coating layer can be constituted especially of boron nitride, but also optionally of graphite or aluminum oxide.

The block is, for example, a cutter for a drilling bit and, after the imbibition treatment, a diamond table of the PDC (polycrystalline diamond compact) or TSP (thermally stable polycrystalline diamond) type can be applied to one face of the block.

The diamond table can be applied directly by a HPHT (high pressure-high temperature) process to the block previously treated by imbibition. It is also possible for the diamond table to be applied to a different homogeneous cermet supporting block, which is subsequently applied by imbibition to the first block treated by imbibition.

In an embodiment, a cutter for a drilling tool for cutting and/or grinding rocks, such as a PDC drill bit, TSP drill bit, a boring bit, a mine pick, a tricone bit, an impregnated tool, comprises a block constituted by metal carbide(s) dispersed in a binder phase especially of the WC-Co type, optionally with added diamonds, which comprises a continuous composition gradient in the binder phase, of a form defined by the function of the tool, so as to obtain a tough core rich in binder phase and a surface poor in binder phase, having a high degree of hardness.

The cutter can further be surmounted by a diamond table of PDC or TSP type on one face of the block.

In an embodiment a rock-cutting tool comprises at least one cutter or blade, the tool being, for example, a tool for an oil and gas- or mine-drilling machine or a civil engineering machine or a ground- or sub-soil-excavating machine.

Another embodiment relates to a rock-grinding and/or rock-cutting tool comprising at least one cutter as described above.

In an embodiment, a process comprises: bringing an imbibition area of a surface of a block constituted by hard particles dispersed in a binder phase, the block being coated with a coating material, into contact with an imbibiting material; and subjecting the block to thermal cycle including heating, dwell temperature and cooling in order to locally and gradually enrich the block with binder phase by imbibition. The thermal cycle causes the imbibiting material and the binder phase of the block to move into the liquid state with the enrichment with binder phase taking place through the imbibition area and creating a continuously varying composition gradient of binder phase within the block.

BRIEF DESCRIPTION OF THE DRAWINGS

The present invention will now be described in greater detail, but without implying any limitation, with reference to the appended drawings, in which.

DETAILED DESCRIPTION OF THE DRAWINGS

Figure 1:
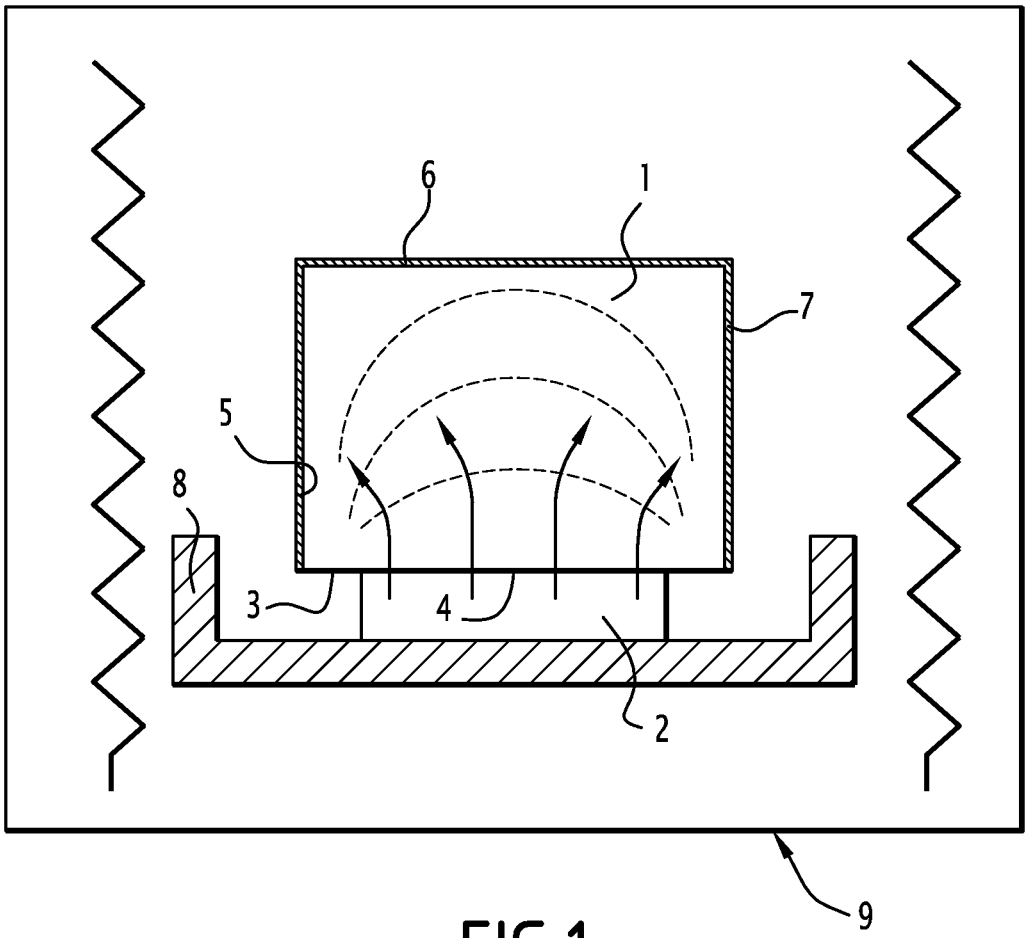
FIG. 1 is a diagram of the production, by imbibition, of a dense cermet block having a hard outside surface and a tough core.

In general, cutters for a drilling tool, or more generally for a cutting tool, are elements comprising blocks of generally parallelepipedal or cylindrical shape which are obtained by powder metallurgy and are constituted by a material whose structure comprises on the one hand hard particles such as metal carbides, and in particular tungsten carbides, and on the other hand a binder phase constituted by a metal or metal alloy which, on contact with the carbides, can form, at temperature, a eutectic having a melting point lower than both the melting point of the carbides and the melting point of the metal or metal alloy. The metal or metal alloy is, for example, cobalt, but may also be iron, or nickel, or a mixture of those metals. In addition, the binder phase can comprise alloying metals, the sum of the contents of which can reach 15% by weight but generally does not exceed 1% by weight. The alloying metals can be copper, for improving the electrical conductivity, or silicon, the effect of which is to lower the surface tension relative to the system constituted by the carbide and by the binder phase, or can be carbide-forming elements which can form mixed carbides or carbides of the $M_xC_y$ type other than tungsten carbide. These different elements are especially manganese, chromium, molybdenum, tungsten, vanadium, niobium, tantalum, titanium, zirconium and hafnium.

In addition to those principal elements, the composition of the binder phase can comprise alloying elements which are conventionally found in such materials and which modify the shape and/or inhibit the growth of the hard particles. The person skilled in the art knows of such elements. Finally, the chemical composition of those materials comprises unavoidable impurities resulting from the preparation processes. The person skilled in the art knows of such impurities.

For some applications, diamond particles are added in order to increase the wear resistance of the cutters. Such diamond particles are added to the powder mixture which is used to produce the block by sintering. In general, after sintering, the block is dense and constituted by hard particles dispersed in a binder phase.

In the case of the WC-Co system, the composition of the eutectic which forms at temperature has a cobalt content of about 65% by weight. Of course, the use properties of the block that are thus obtained depend especially on the relative proportions of carbide(s) and of metal or metal alloy. In the case of drilling materials, the content of binder phase is generally far lower than that of the eutectic and even substantially less than 35% by weight. In fact, the lower the content of binder phase, the higher the hardness, and hence the wear resistance, of the material. However, the lower the content of binder phase, the lower the toughness of the cermet. These properties of cermets are known to the person skilled in the art.

Furthermore, the properties of the cermet also depend on the size and shape of the carbide grains.

In order to improve the properties of the blocks, a method is presented for enriching part of the block with binder phase and optionally modifying its composition, by imbibition, starting from a dense sintered cermet.

The phenomenon of imbibition is possible in biphase systems (hard particles—binder phase) that fulfill certain conditions. Accordingly, the binder phase, at the imbibition temperature ($T \geq Te$), must wet the hard particles, those same hard particles must be partially soluble in the binder phase at the imbibition temperature, and the system must exhibit Ostwald maturation with modification or not of the shape of the hard particles without necessarily an increase in the size of the particles by the dissolution-reprecipitation phenomenon.

In order to carry out the imbibition it is necessary to bring a cermet having a content of binder phase below a critical content (35% by weight in the case of the WC-Co system) in contact with an imbibiting material of a suitable composition and to bring the whole to such a temperature that the imbibiting material and the binder phase are liquid or at least partially liquid. When those conditions are met, transfer of binder phase to the inside the cermet takes place, and the cermet is therefore enriched with binder phase. In general, the composition of the imbibiting material is preferably identical with or similar to that of the eutectic of the cermet in question. In that case, the imbibition increases the content of binder phase in the cermet without modifying the chemical composition of the material. This phenomenon can continue until the cermet is saturated with binder phase. For a cermet of the tungsten carbide/cobalt type with an imbibiting material of the same nature, saturation is obtained for a cobalt content of about 35% by weight in the cermet.

The imbibiting material can have a different composition to that of the binder phase of the cermet. In that case, not only is the cermet enriched with binder phase, but the chemical composition thereof, and optionally of the carbide phase, is also modified.

The imbibition phenomenon is activated thermally and its kinetics is therefore linked to not only the temperature but also to the initial content of binder phase in the cermet, as well as to the size and shape of the hard particles.

Imbibition is generally used to enrich cermet blocks with binder phase by immersing one of their ends in a liquid having the composition of the eutectic of the cermet in question. A disadvantage of that method is that the imbibiting material migrates into the cermet not only through the contact zone(s) but also through the faces that are adjacent to the contact zone(s), making the shape of the gradient difficult to control.

Therefore, in order to obtain the desired result, which is the inverse of the result conventionally obtained with immersion, a novel procedure is described below.

As is shown in FIG. 1, there is a block 1 to be treated, which is made of a material constituted by hard particles embedded in a binder phase, in contact with a pellet 2 constituted by an imbibiting material which, from a certain temperature, is capable of migrating to the inside of the block 1 by imbibition. The block 1 is generally cylindrical or parallelepipedal in shape and comprises a lower face 3, one or more side faces 5 and an upper face 6. The pellet 2 of imbibiting material is in contact with the lower face 3 of the block 1, and the contact area 4 between the pellet 2 of imbibiting material and the block 1, also called the imbibition area, has a surface area substantially smaller than the surface area of the lower face 3 of the block 1. The shape of the gradient is determined especially by the positioning and the extent of the imbibition area relative to the lower face 3 of the cermet.

The lateral face or faces 5 and the upper face 6 of the block 1 are covered with a layer 7 of a coating material. The coating material, which is boron nitride, for example, is intended on the one hand to prevent the transfer of imbibiting material through the protective layer and on the other hand to modify the kinetics of migration of the binder phase into the block and the shape of the gradient properties.

The assembly constituted by the block 1, with its coating layer 7, and by the pellet 2 of imbibiting material is disposed in a crucible which is chemically inert at the temperatures of the thermal treatment, for example made of aluminum oxide 8, and which is placed in an oven 9 under a controlled atmosphere, which may be a vacuum oven or an oven under a nitrogen or argon atmosphere. The oven must be capable of reaching a sufficient temperature, so that the imbibiting material and the binder phase of the block are partially or totally in the liquid state, for example 1350° C. (or even 1320° C.) in the case of a block of WC-Co. The oven must further be capable of high heating and cooling rates so that it is possible to control the time which the assembly will spend above the eutectic temperature of the treated system, which is the temperature above which imbibition occurs and which, for cermets of the WO-Co type, is of the order to 1300° C. The oven can be a resistance oven, an induction oven, a microwave oven or a SPS (spark plasma sintering) installation.

The block is then subjected to a thermal cycle, which first comprises heating to a temperature higher than or equal to the temperature at which at least the contact zone 4 between the pellet 2 of imbibiting material and the lower surface 3 of the block 1 passes into the liquid state. Heating is carried out in such a manner that the temperature inside the block is higher than the melting point Te of the eutectic of the block.

Preferably, the natural temperature gradient of the oven will be used, so that heating is carried out in such a manner that the temperature inside the pellet 2 remains below the melting point of the imbibiting material.

By proceeding in that manner, the imbibiting material penetrates, by migration, into the inside of the block in the region of the contact zone between the pellet of imbibiting material and the lower surface of the block. On the other hand, it does not migrate through the outer side walls 5 or through the upper wall 6 of the block. Accordingly, enrichment of the block with imbibiting material occurs substantially in an inner zone which opens at the lower wall 3 and extends towards the inside of the block.

Figure 2:
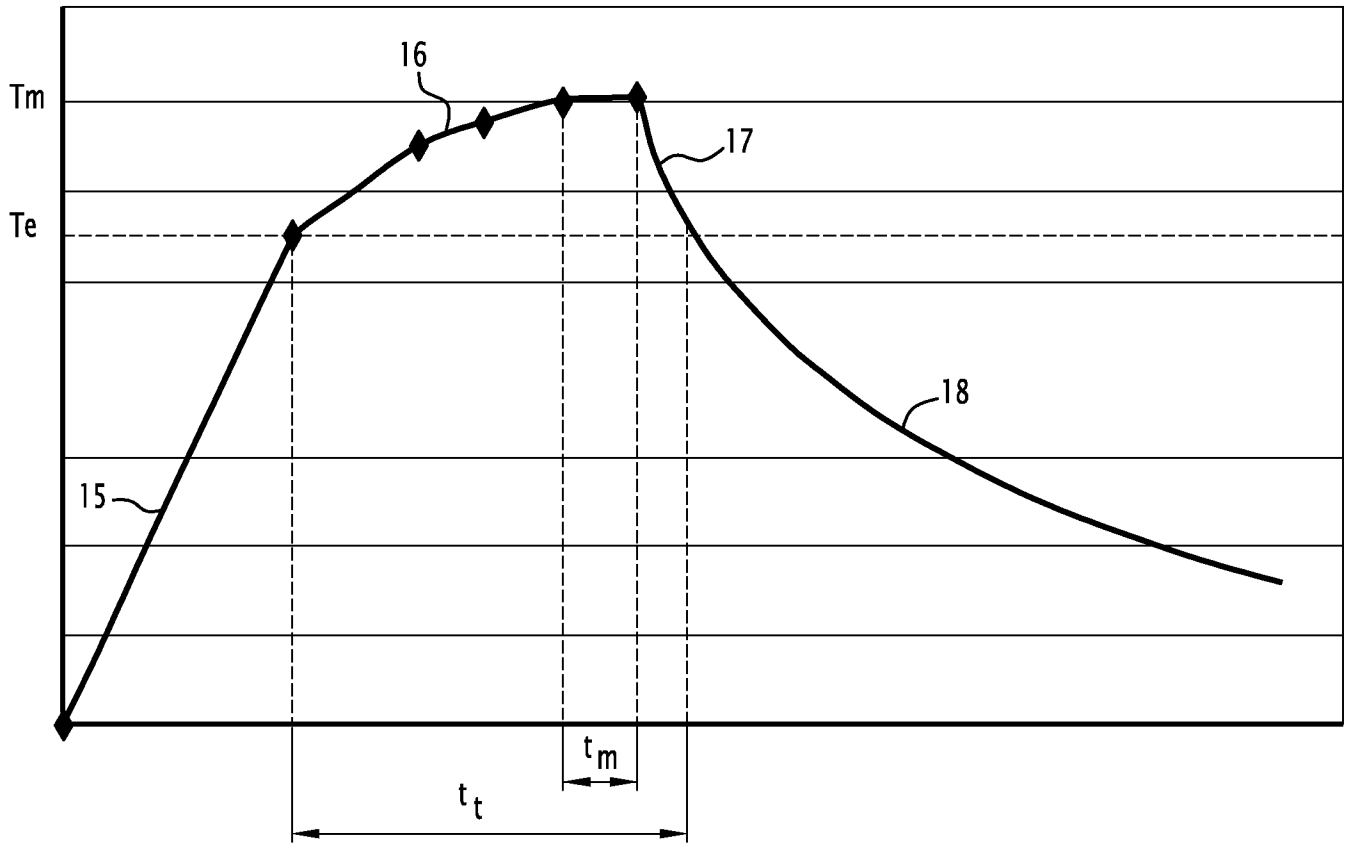
FIG. 2 is a diagram of a thermal imbibition cycle of a dense cermet block having a hard outside surface and a tough core.

More precisely, the thermal treatment comprises, as is shown in FIG. 2, a phase 15 of heating to the melting point Te of the eutectic, then a phase 16 in which the temperature is maintained above the temperature Te to a holding temperature Tm at which the block is maintained for a holding time $t_m$, then a phase 17 in which the block is cooled very rapidly to a temperature below the temperature Te and, finally, a phase 18 of slower cooling to ambient temperature.

During the heating phase, below the temperature Te, the imbibiting material solidifies and undergoes shrinkage. Above the temperature Te, a eutectic liquid forms at the contact surface.

The threshold (dwell) temperature must not be too different from the temperature Te, but must be sufficiently different to produce enough liquid and permit wetting and migration of a liquid in chemical equilibrium with the cermet to be imbibited. That temperature difference is, for example, not more than 100° C. and preferably less than 50° C.

The total time $t_t$ above the minimum imbibition temperature Te, in general less than 15 minutes, as well as the holding temperature Tm and the holding time $t_m$, are chosen to ensure suitable distribution of the imbibiting material inside the block. The person skilled in the art knows how to choose those parameters.

Cooling between the threshold temperature and the eutectic imbibition temperature is carried out rapidly so as to avoid uncontrolled migration of the imbibiting material.

To that end, it is desirable for the rate of rapid cooling to be greater than 40° C./min., preferably greater than 50° C./min. and more preferably greater than 60° C./min. However, in order to avoid producing excessive stresses in the block, it is preferable for the cooling rate to remain below 100° C./min.

Below the eutectic temperature Te, because migration of the imbibiting material is prevented, cooling is carried out at a substantially slower rate in order to avoid generating excessive residual stresses inside the block.

Figure 3:
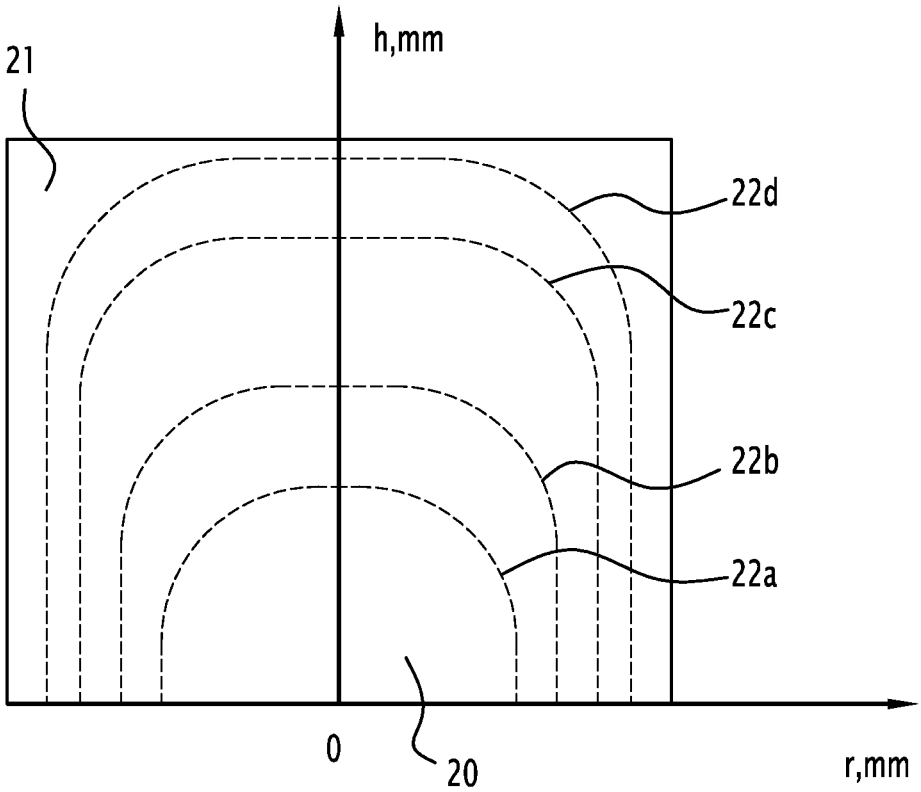
FIG. 3 is a diagram in section of a dense cermet, the core of which has been made tougher by imbibition.

By proceeding in that manner, blocks such as that shown in section in FIG. 3 are obtained, comprising a core 20 having a high content of binder phase and an outside zone 21 having a low content of binder phase. Because of its low content of binder phase, the outside zone 21 has very high hardness, and therefore very high wear resistance, but low toughness. By contrast, because of its high content of binder phase, the inside zone 20 has very good toughness.

Figure 4:
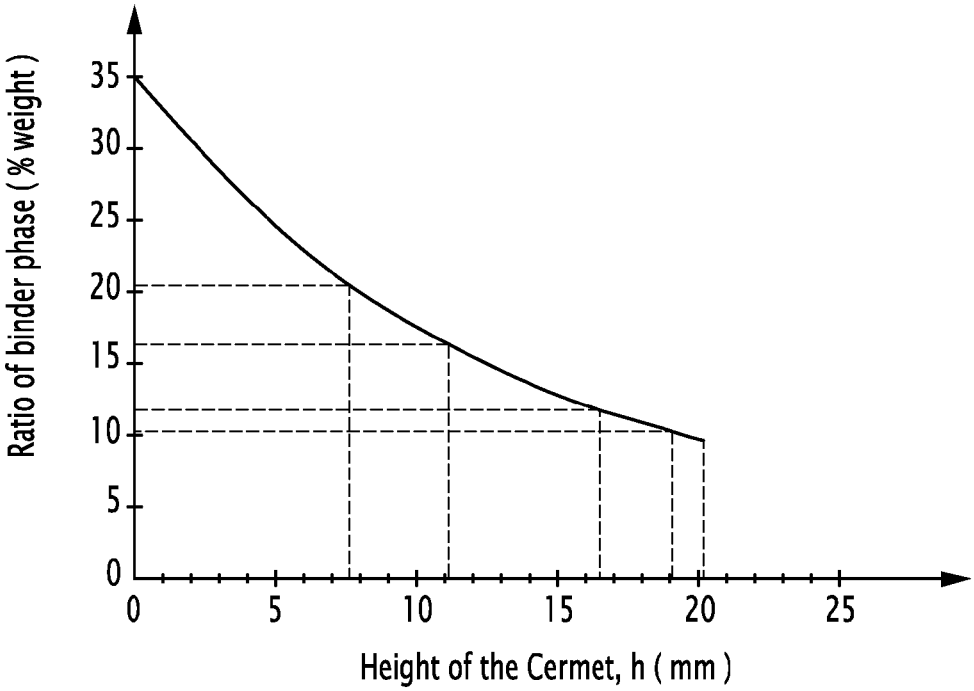
FIG. 4 is a diagram illustrating a comparison between height of cermet and ration of binder phase.

Owing to the imbibiting process which has just been described and which corresponds to a gradual enrichment of the cermet with binder phase, the change in the content of binder phase takes place continuously and diminishes from the core towards the active faces of the block. This is shown diagrammatically by dotted lines of equal binder phase content 22*a*, 22*b*, 22*c*, 22*d* and in FIG. 4 by a profile of repartition of the binder phase along the height from the lower face to the upper face of the dense cermet.

When the cermet block is of the tungsten carbide/cobalt type, it must have a cobalt content less than 35% by weight. Above that content, the imbibiting process stops. In order to enrich such a block with its own binder, the block is brought into contact with an imbibiting material constituted by a mixture of tungsten carbide/cobalt in which the cobalt content can vary from 35 to 65% by weight. Preferably, for the WC-Co system, the mixture has the eutectic composition corresponding to 65% by weight cobalt. The tungsten carbide/cobalt mixture is homogenized, preferably in a Turbula, for several hours. The mixture is then compacted, for example at low temperature in a single-action mould, or is mixed with an aqueous cement. When the imbibiting material is compacted at low temperature, it is in the form of pellet which is brought into contact with the coated block that is to be treated. When the imbibiting material is constituted by a powder mixed with an aqueous cement, it can be deposited on the coated block by means of a brush in a delimited zone which can be of any shape. It can also be deposited by techniques of the plasma projection or laser projection type. The technique of deposition by means of a brush or by projection has the advantage of allowing the imbibiting material to be deposited in any zone of a block, the shape of which can be more complex than that of a parallelepiped or a cylinder.

It will be noted that, for each coated block to be treated, the size and shape of the imbibition area must be adapted to the shape of the gradient that is to be generated inside the block. The person skilled in the art knows how to make such adaptations.

In the embodiment which has just been described, it is provided to cover the outside surface of the block to be treated with a coating material. However, provided that the imbibition area is limited and does not extend at the imbibition temperature, it is not essential to cover the outside surface of the block with a coating material. The imbibition area can, in fact, be limited to a single face, which results in migration that occurs solely in an inside axial portion of the block.

Beside, it has been found, that the presence of the coating layer on the outside surface of the block had a significant effect on the migration of the imbibiting material inside the block. In particular, it has been found that the coating layer makes it possible to obtain a binder phase gradient, and consequently a hardness gradient, which is much more considerable than that which can be obtained in the absence of the coating material.

That effect is illustrated by the two examples which follow, which both relate to the treatment of a dense block of tungsten carbide/cobalt in which the cobalt content prior to treatment is 13% by weight, the imbibiting material being constituted by a pellet of tungsten carbide/cobalt having a eutectic composition, that is to say containing about 65% by weight cobalt. In both cases, the assembly is disposed in an aluminum oxide crucible inside a resistance oven and is heated at a temperature of 1350° C. (sample temperature) for 3 minutes.

In the first example, the outside walls of the block which were not to come into contact with the imbibiting material were covered with a coating material constituted by boron nitride. After treatment, the hardness in the vicinity of the outside surface of the block was of the order of 1370 HV, while the minimum hardness inside the core of the block was only 890 HV, namely a difference in hardness of the order of 480 HV, it being possible for the variation in hardness to be obtained over distances of the order of 5 mm.

In the second example, the outside walls of the block were not covered with the coating layer. The maximum hardness observed was 1200 HV at the outside surface of the block, and the minimum hardness at the core of the block was 1010 HV, which corresponds to a difference of only 190 HV.

There can be different explanations for the difference between these two results. It is possible especially to think that the coating material increases the interfacial energy between the binder phase and the carbide phase and therefore has an effect on the migration of the binder phase to the inside of the block.

The process which has just been described, and which permits the production of blocks which are to constitute tool bits, has the advantage of allowing blocks to be obtained whose outside portion is hard and whose inside portion is tough.

Figure 5:
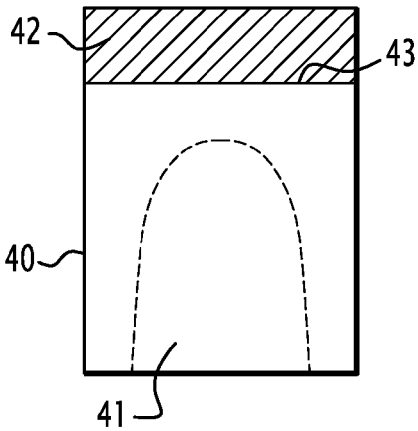
FIG. 5 is a view in section of a cutter for a drilling tool constituted by a dense cermet block, the core of which has been made tougher and to which a diamond tip has been applied.

In addition, it has been found that, after imbibition of the block, it is possible to deposit on the upper face of the block a synthetic diamond table, while retaining in part the gradient obtained by the imbibition treatment. The layer of diamond can be put in place by the pressing of a synthetic diamond or graphite powder by a HPHT (high pressure-high temperature) process. There is then obtained a cutter as shown in section in FIG. 5, which is constituted by a supporting block 40 of cermet, the core 41 of which has been enriched with binder phase by imbibition so as to be tougher, and by a diamond table 42 applied to a face 43 of the supporting block.

When the diamond table has been applied to a block which has been treated with a coating layer as has just been described, the amplitude of the hardness gradient inside the supporting block is only 350 HV instead of 480 HV, but the maximum hardness at the periphery of the sample is 1550 HV instead of 1370 HV and the minimum hardness is 1200 HV at the bottom of the block instead of 890 HV, that is to say a supporting block which is harder at the surface but slightly less tough at the core as compared with the same treated block prior to the HPHT operation.

This change in the hardness results from the diamond pressing operation, which has an effect on the cobalt gradient and hence on the hardness of the support of the diamond tip.

Figure 6:
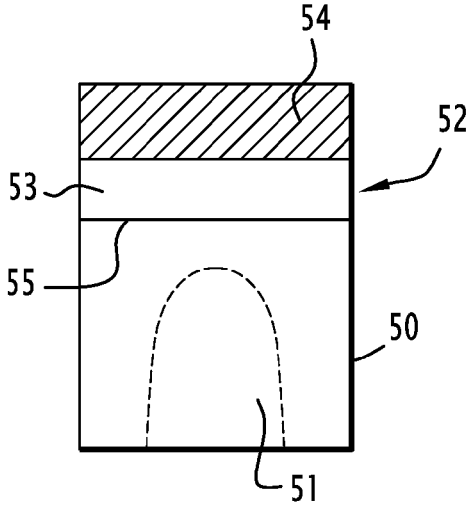
FIG. 6 is a view in section of a cutter for a drilling tool comprising a first cermet block, the core of which has been made tough and to which there has been applied, by imbibition, a second block surmounted by a diamond tip.

In order to deposit a layer of diamond on a cermet supporting block, it is also possible to proceed according to a second method, which is shown in FIG. 6.

According to the second method, a cermet block 50 is used which has been treated according to one or other of the imbibiting methods described above in order to give it a core 51 whose toughness has been improved by increasing the content of binder phase. There is applied to that cermet, by imbibition, a cutter 52 constituted by a supporting block 53 of homogeneous cermet on which there has previously been pressed a diamond table 54.

The compositions of the blocks 53 and 50 are so chosen that, when they are brought into contact and brought to a temperature higher than or equal to the eutectic temperature, migration of binder phase from one of the blocks to the other occurs, in order to ensure the perfect assembly of the two blocks. In order to obtain that result, it is expedient to choose, for the blocks 53 and 50, cermets having compositions and/or sizes and/or shapes of hard particles such that the migration pressures are different. Those migration pressures depend especially on the size and shape of the carbide particles and on the content of binder phase. The person skilled in the art knows how to choose such cermet structures.

The process which has just been described permits the production of bits for the heads of drilling tools such as tricone bits, PDC bits or TSP bits, impregnated bits for oil and gas drilling, or bits for rock-cutting or rock-fragmenting tools or for the drilling of blast holes, in the field of mining, civil engineering, or tools for working materials.

Such cutters are elements which comprise at least one block obtained by the process as described or which are constituted by such a block. Such blocks can have very different shapes, which are adapted to the tool for which they are intended. They can accordingly constitute blades.

Such cutters can be fitted to any type of tool for oil and gas drilling or mine drilling or in the civil engineering field, especially to any ground- or subsoil-excavating machine. Those applications are in particular picks used on mining machines of the "localized excavation" type or of the "continuous mining" type or of the "coal cutter" type or machines for tunneling into soft rock. Such applications can also be wheels used especially on full-section machines, such as tunneling machines or road-boring machines, or rotary drilling bits or roto-percussive drilling bits.

The process can also be used for producing elements for metalworking tools, for which it is desirable to obtain a very hard active surface on a tougher body.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A production process, comprising:

depositing a coating material over at least part of a surface of a block of completely dense sintered cermet material constituted by hard particles dispersed in a binder phase, leaving free at least one imbibition area of the surface;

bringing the imbibition area of the surface of the block into contact with an imbibiting binder material having properties which support locally enriching the binder phase within the block with the imbibiting binder material; and subjecting the block in contact with the imbibiting binder material to a suitable thermal cycle, constituted by heating, temperature maintenance and cooling, which brings at least some of the imbibiting binder material and the binder phase of the block into the liquid state, so as to locally and gradually enrich the completely dense sintered cermet material block with the imbibiting binder material by imbibition through the imbibition area, the coating material modifying kinetics of migration of the imbibiting binder material into the block, wherein the block possesses after cooling a gradient of binder content within the block which exhibits a gradual binder phase distribution.

2. The process according to claim 1, wherein a size of the imbibition area on the surface of the block in contact with the imbibiting material is less than an overall area of the surface of the block.

3. The process according to claim 1, wherein subjecting comprises carrying out the thermal cycle in such a manner that there forms, in an assembly comprised of the block and the imbibiting material, a temperature gradient such that a minimum imbibition temperature is reached at an interface between the block and the imbibiting material and within the block near the interface there exists an imbibition temperature that is higher than the minimum imbibition temperature and further, in the imbibiting material in the vicinity of the interface an imbibition temperature is reached below the minimum imbibition temperature.

4. The process according to claim 3, wherein the imbibition temperature is a melting point of an eutectic of the imbibiting material.

5. The process according to claim 4, wherein subjecting comprises:

providing a temperature rise to a holding temperature which is within a range comprising an eutectic temperature of the imbibiting material Te and Te+100° C.;

holding at the holding temperature for a holding time tm set as a function of a geometry of the block and of a geometry of a desired temperature gradient, and of a desired gradual distribution of the imbititing material in the block;

first rapidly cooling at greater than 40° C./min to a temperature below Te; and second slowly cooling at less than 10° C./min to ambient temperature.

6. The process according to claim 1, wherein subjecting comprises carrying out the thermal cycle in such a manner that an amount of time spent in the liquid state at a holding temperature generates a liquid volume of the imbibiting binder material sufficient for achieving an enrichment wherein the gradual binder phase distribution exhibited by the gradient in binder content is defined by binder content that is higher near the imbibition area and which decreases within the material block in a direction away from the imbibition area.

7. The process according to claim 1, wherein the imbibiting binder material is a pellet constituted by an agglomerated powder mixture, one face of which is in contact with the surface of the block.

8. The process according to claim 1, wherein the imbibiting binder material is in the form of a covering deposited on a surface of the block.

9. The process according to claim 1, wherein the block in contact with the imbibiting binder material is heated in an oven under either a controlled atmosphere or in vacuum.

10. The process according to claim 1, wherein the solid particles constituting the material of the block comprise hard metal carbide particles, and wherein the binder phase is of metallic nature.

11. The process according to claim 8, wherein the block further comprises natural or synthetic diamond particles, of a size up to 1 mm in diameter.

12. The process according to claim 10, wherein the imbibiting binder material is constituted by second hard particles dispersed in a second binder phase not necessarily the same as the hard particles and binder phase of the block.

13. The process according to claim 12, wherein a chemical composition of the imbibiting material is:

at least 85% by weight of an eutectic formed between the metal carbide particles of the block and the binder phase, such that a difference between a melting point of the second binder phase of the imbibiting material and the binder phase of the block is less than 200° C.; and of not more than 15% by weight of one or more metal elements selected from the group consisting of Cu, Si, Mn, Cr, Mo, W, V, Nb, Ta, Ti, Zr, Hf.

14. The process according to claim 1, wherein the material constituting the block is a cermet of the WC-Co or WC-(Co and/or Ni and/or Fe) type and wherein the imbibiting material is of the WC-M type, M being constituted by one or more metals selected from the group consisting of Co, Ni and Fe.

15. The process according to claim 14, wherein the cermet constituting the block is of the WC-Co type and comprises not more than 35% by weight cobalt, and the imbibiting material has a cobalt content of from 35 to 65% by weight.

16. The process according to claim 1, wherein the coating layer comprises a material selected from the group consisting of a boron nitride, a graphite or an aluminum oxide.

17. The process according to claim 1, further comprising depositing on one face of the block after imbibition a diamond table of either the PDC (polycrystalline diamond compact) or TSP (thermally stable polycrystalline diamond) type.

18. The process according to claim 17, wherein depositing comprises applying the diamond table directly to the block by use of a high pressure and high temperature treatment.

19. The process according to claim 17, wherein the diamond table is carried by a cermet, and depositing comprises applying the diamond table to the block by an imbibition treatment.

20. The process according to claim 1 wherein the modified kinetics of migration shapes the gradient of binder content within the block.

21. A process, comprising:

coating at least part of a surface of a block of completely dense sintered cermet material constituted by hard particles dispersed in a binder phase, leaving free at least one imbibition area of the surface;

bringing the imbibition area into contact with an imbibiting binder material;

subjecting the block to thermal cycle including heating, temperature maintenance and cooling in order to locally enrich the block with imbibiting binder material by imbibition;

wherein the thermal cycle causes the imbibiting binder material and the binder phase of the block to move into the liquid state with the enrichment with imbibiting binder material taking place through the imbibition area and creating a continuously varying content gradient of binder within the block.

22. The process according to claim 21, wherein the block further comprises diamond particles of a size up to 1 mm in diameter.

23. The process according to claim 21, wherein subjecting comprises:

heating to reach a holding temperature which is at or above an eutectic temperature of the imbibiting material;

holding at the holding temperature for a holding time necessary to achieve a desired temperature gradient in the block; and cooling the block.

24. The process according to claim 21 wherein the coating on the surface of the block modifies kinetics of migration of the imbibiting binder material into the block so as to shape the continuously varying content gradient of binder within the block.

25. The process according to claim 21, further comprising depositing on one face of the block after imbibition a diamond table of either a PDC (polycrystalline diamond compact) or a TSP (thermally stable polycrystalline diamond) type.

26. The process according to claim 25, wherein depositing comprises applying the diamond table directly to the block by use of a high pressure and high temperature treatment.

27. The process according to claim 25, wherein depositing comprises applying the diamond table to the block by an additional imbibition treatment.

28. A process, comprising:

applying a coating layer to at least part of a surface of a completely dense sintered WC-M1 cermet material block, leaving free at least one surface imbibition area, wherein M1 is a first binder material distributed within the material block;

bringing the surface imbibition area into contact with an M2-based imbibiting material, wherein M2 is a second binder material; and subjecting the material block to thermal cycle including heating, temperature maintenance and cooling which moves the M1 binder and M2-based imbibiting material into the liquid state, the M2-based imbibiting material being locally enriched into the material block by imbibition to create a binder phase within the block after the thermal cycle is completed which exhibits a content distribution gradient wherein the binder phase is higher in content near the surface imbibition area and decreases within the material block in a direction away from the surface imbibition area.

29. The process of claim 28 wherein subjecting further comprises applying a controlled atmosphere.

30. The process of claim 29 wherein the controlled atmosphere is a vacuum.

31. The process of claim 28, wherein M1 is cobalt (Co) with the sintered WC-M1 cermet material block having a cobalt content of not more than 35% by weight, and wherein M2 is cobalt (Co) with the M2-based imbibiting material having a cobalt content of from 35 to 65% by weight.

32. The process of claim 28, wherein the coating layer comprises a material selected from the group consisting of a boron nitride, a graphite or an aluminum oxide.

33. The process of claim 28, wherein the sintered WC-M1 cermet material block has a cylindrical shape including a first flat surface and a second flat surface, wherein the surface imbibition area is provided on the first flat surface.

34. The process of claim 33, further comprising depositing a diamond table of either a PDC (polycrystalline diamond compact) or a TSP (thermally stable polycrystalline diamond) type on the second flat surface.

35. The process of claim 34, wherein depositing comprises applying the diamond table to the second flat surface by use of a high pressure and high temperature treatment.

36. The process of claim 33, further comprising depositing a WC substrate, which carries a diamond table, on the second flat surface.

37. The process of claim 36, wherein depositing comprises applying the WC substrate to the second flat surface by imbibition treatment.

38. The process of claim 28, wherein the content distribution gradient is defined by a curved relationship between binder phase content and distance from the surface imbibition area.

39. The process of claim 28, wherein M1 is a material selected from the group consisting of Co, Ni and Fe, and wherein M2 is a material selected from the group consisting of Co, Ni and Fe.

40. The process of claim 28, wherein M1 and M2 are both cobalt (Co), and the higher content of binder phase near the surface imbibition area is approximately 35% by weight and the decrease in binder phase content reaches approximately 10-15% by weight within the material block.

41. The process of claim 28 wherein the coating layer on the surface of the block modifies kinetics of migration of the M2-based imbibiting material into the block so as to shape the content distribution gradient of binder phase within the block.

42. A process, comprising:

applying a coating layer to at least part of a surface of a completely dense sintered WC-M1 cermet material block which includes diamond particles, leaving free at least one surface imbibition area, wherein M1 is a first binder material distributed within the material block;

bringing the surface imbibition area into contact with an M2-based imbibiting material, wherein M2 is a second binder material; and subjecting the material block to thermal cycle including heating, temperature maintenance and cooling which moves the M1 binder and M2-based imbibiting material into the liquid state, the M2-based imbibiting material being locally enriched into the material block by imbibition to create a binder phase within the block after the thermal cycle is completed which exhibits a content distribution gradient wherein the binder phase is higher in content near the surface imbibition area and decreases within the material block in a direction away from the surface imbibition area.

43. The process of claim 42, wherein M1 is a material selected from the group consisting of Co, Ni and Fe, M1, and wherein M2 is a material selected from the group consisting of Co, Ni and Fe.

44. The process of claim 42, wherein the coating layer comprises a material selected from the group consisting of a boron nitride, a graphite or an aluminum oxide.

45. The process of claim 42 wherein the coating layer on the surface of the block modifies kinetics of migration of the M2-based imbibiting material into the block so as to shape the content distribution gradient of binder phase within the block.

* * * * *